US007147440B2

(12) United States Patent
Benjamin et al.

(10) Patent No.: US 7,147,440 B2
(45) Date of Patent: Dec. 12, 2006

(54) METHODS AND APPARATUS FOR COOLING GAS TURBINE ENGINE ROTOR ASSEMBLIES

(75) Inventors: Edward Durell Benjamin, Simpsonville, SC (US); Jeffrey John Butkiewicz, Simpsonville, SC (US); John Paul Urban, Omaha, NE (US)

(73) Assignee: General Electric Company, Schenectady, NY (US)

( * ) Notice: Subject to any disclaimer, the term of this patent is extended or adjusted under 35 U.S.C. 154(b) by 119 days.

(21) Appl. No.: 10/828,133

(22) Filed: Apr. 20, 2004

(65) Prior Publication Data

US 2005/0095129 A1 May 5, 2005

Related U.S. Application Data

(63) Continuation-in-part of application No. 10/699,060, filed on Oct. 31, 2003.

(51) Int. Cl.
*F01D 1/02* (2006.01)

(52) U.S. Cl. ..... 416/193 A

(58) Field of Classification Search ..... 415/115; 416/189, 97 R, 193 A
See application file for complete search history.

(56) References Cited

U.S. PATENT DOCUMENTS

| | | | | |
|---|---|---|---|---|
| 6,017,189 | A * | 1/2000 | Judet et al. | 416/97 R |
| 6,210,111 | B1 * | 4/2001 | Liang | 416/97 R |
| 6,273,683 | B1 | 8/2001 | Zagar et al. | |
| 6,478,540 | B1 | 11/2002 | Abuaf et al. | |
| 6,672,829 | B1 * | 1/2004 | Cherry et al. | 415/115 |
| 6,984,112 | B1 * | 1/2006 | Zhang et al. | 416/193 A |

* cited by examiner

*Primary Examiner*—Edward K. Look
*Assistant Examiner*—Devin Hanan
(74) *Attorney, Agent, or Firm*—Armstrong Teasdale LLP

(57) ABSTRACT

A method facilitates assembling a rotor assembly for gas turbine engine. The method comprises providing a first rotor blade that includes an airfoil having a leading edge and a trailing edge including a plurality of trailing edge openings, a platform, a shank, and a dovetail, wherein the platform extends between the airfoil and the dovetail and includes a radially outer surface, a radially inner surface, and a recessed area extending at least partially between the radially outer and inner surfaces. The method also comprises coupling the first rotor blade to a rotor shaft using the dovetail, and coupling a second rotor blade to the rotor shaft such that cooling air is substantially continuously channeled through the platform recessed area during engine operation to facilitate reducing stresses induced to at least a portion of the airfoil trailing edge.

24 Claims, 6 Drawing Sheets

METHODS AND APPARATUS FOR COOLING GAS TURBINE ENGINE ROTOR ASSEMBLIES

CROSS REFERENCE TO RELATED APPLICATION

This application is a continuation-in-part of U.S. patent application Ser. No. 10/699,060 filed Oct. 31, 2003, which is hereby incorporated by reference.

BACKGROUND OF THE INVENTION

This application relates generally to gas turbine engines and, more particularly, to methods and apparatus for cooling gas turbine engine rotor assemblies.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

During operation, because the airfoil portions of the blades are exposed to higher temperatures than the shank and dovetail portions, temperature mismatches may develop at the interface between the airfoil and the platform, and/or between the shank and the platform. Over time, such temperature differences and thermal strain may induce large compressive thermal stresses to the blade platform. Moreover, over time, the increased operating temperature of the platform may cause platform oxidation, platform cracking, and/or platform creep deflection, which may shorten the useful life of the rotor blade. Furthermore, such temperature differences may also induce stresses into root trailing edge openings, which over time may also shorten the useful life of the rotor blade by inducing cracking at the exit of such openings.

To facilitate reducing the effects of the high temperatures in the platform region, at least some known rotor blades include a cooling opening formed within the shank. More specifically, within at least some known shanks the cooling opening extends through the shank for providing cooling air into a shank cavity defined radially inward of the platform. However, within known rotor blades, such cooling openings may provide only limited cooling to the rotor blade platforms.

BRIEF SUMMARY OF THE INVENTION

In one aspect, a method for assembling a rotor assembly for gas turbine engine is provided. The method comprises providing a first rotor blade that includes an airfoil having a leading edge and a trailing edge including a plurality of trailing edge openings, a platform, a shank, and a dovetail, wherein the platform extends between the airfoil and the shank and includes a radially outer surface, a radially inner surface, and a recessed area extending at least partially between the radially outer and inner surfaces. The method also comprises coupling the first rotor blade to a rotor shaft using the dovetail, and coupling a second rotor blade to the rotor shaft such that cooling air is substantially continuously channeled through the platform recessed area during engine operation to facilitate reducing stresses induced to at least a portion of the airfoil trailing edge.

In another aspect, a rotor blade for a gas turbine engine is provided. The rotor blade includes a platform, an airfoil, a shank, a dovetail, and a cooling circuit. The platform includes a radially outer surface, a radially inner surface, and a recessed area extending at least partially therebetween. The airfoil extends radially outward from the platform, and includes a first sidewall and a second sidewall connected together along a leading edge and a trailing edge. The shank extends radially inward from the platform. The dovetail extends from the shank. The cooling circuit extends through a portion of the shank for channeling cooling air through the platform recessed area during engine operation to facilitate reducing stresses induced to at least a portion of the airfoil trailing edge.

In a further aspect, a gas turbine engine rotor assembly is provided. The rotor assembly includes a rotor shaft, and a plurality of circumferentially-spaced rotor blades coupled to the rotor shaft. Each rotor blade includes an airfoil, a platform, a shank, a cooling circuit, and a dovetail. Each airfoil extends radially outward from the platform, and each platform includes a radially outer surface, a radially inner surface, and a recessed area extending at least partially therebetween. Each shank extends radially inward from the platform, and each dovetail extends from the shank for coupling the rotor blade to the rotor shaft. Each cooling circuit extends through a portion of the shank for channeling cooling air through the platform recessed area during engine operation to facilitate reducing stresses induced to at least a portion of the airfoil trailing edge.

DETAILED DESCRIPTION OF THE INVENTION

Figure 1:
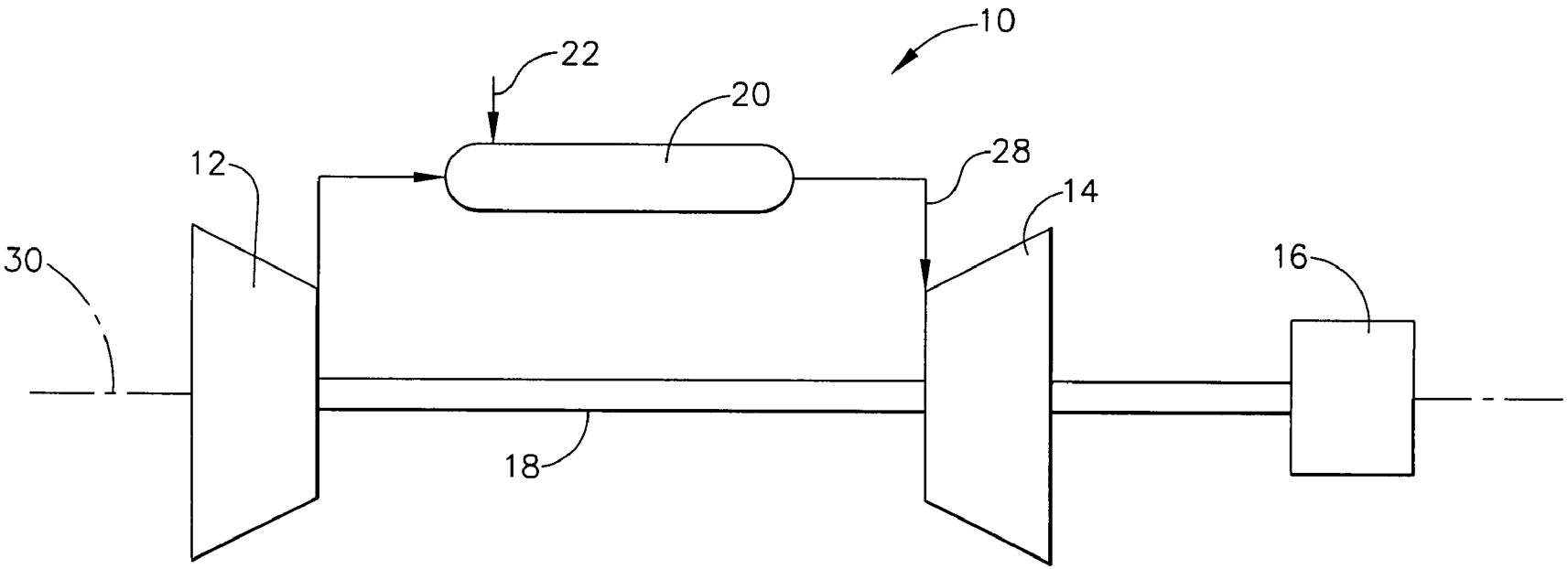
FIG. 1 is schematic illustration of a gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single monolithic rotor or shaft 18. In an alternative embodiment, shaft 18 is segmented into a plurality of shaft segments, wherein each shaft segment is coupled to an adjacent shaft segment to form shaft 18. Compressor 12 supplies compressed air to a combustor 20 wherein the air is mixed with fuel supplied via a stream 22. In one embodiment, engine 10 is a 9FA+e gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
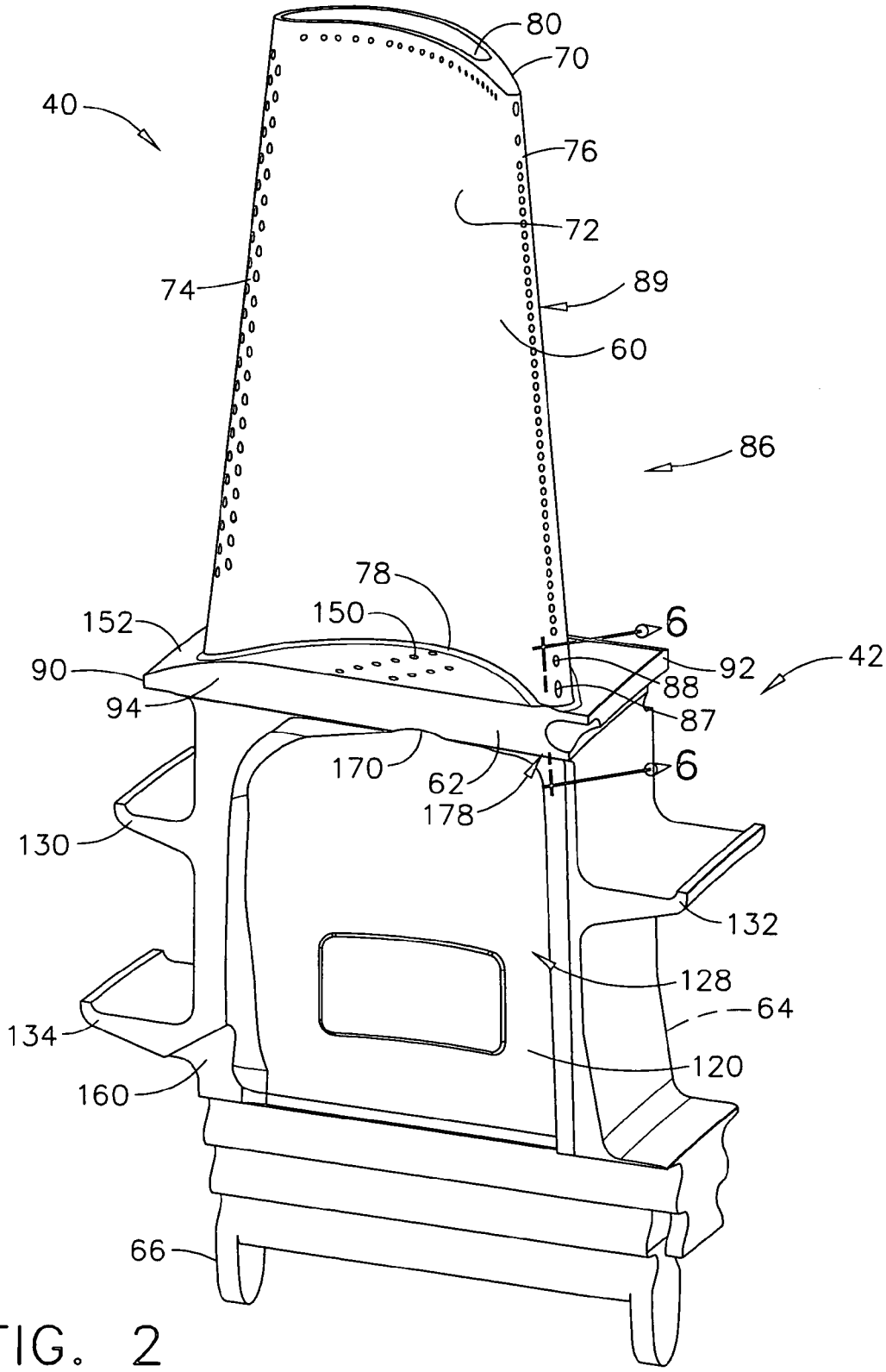
FIG. 2 is an enlarged perspective view of a rotor blade that may be used with the gas turbine engine shown in FIG. 1.
Figure 3:
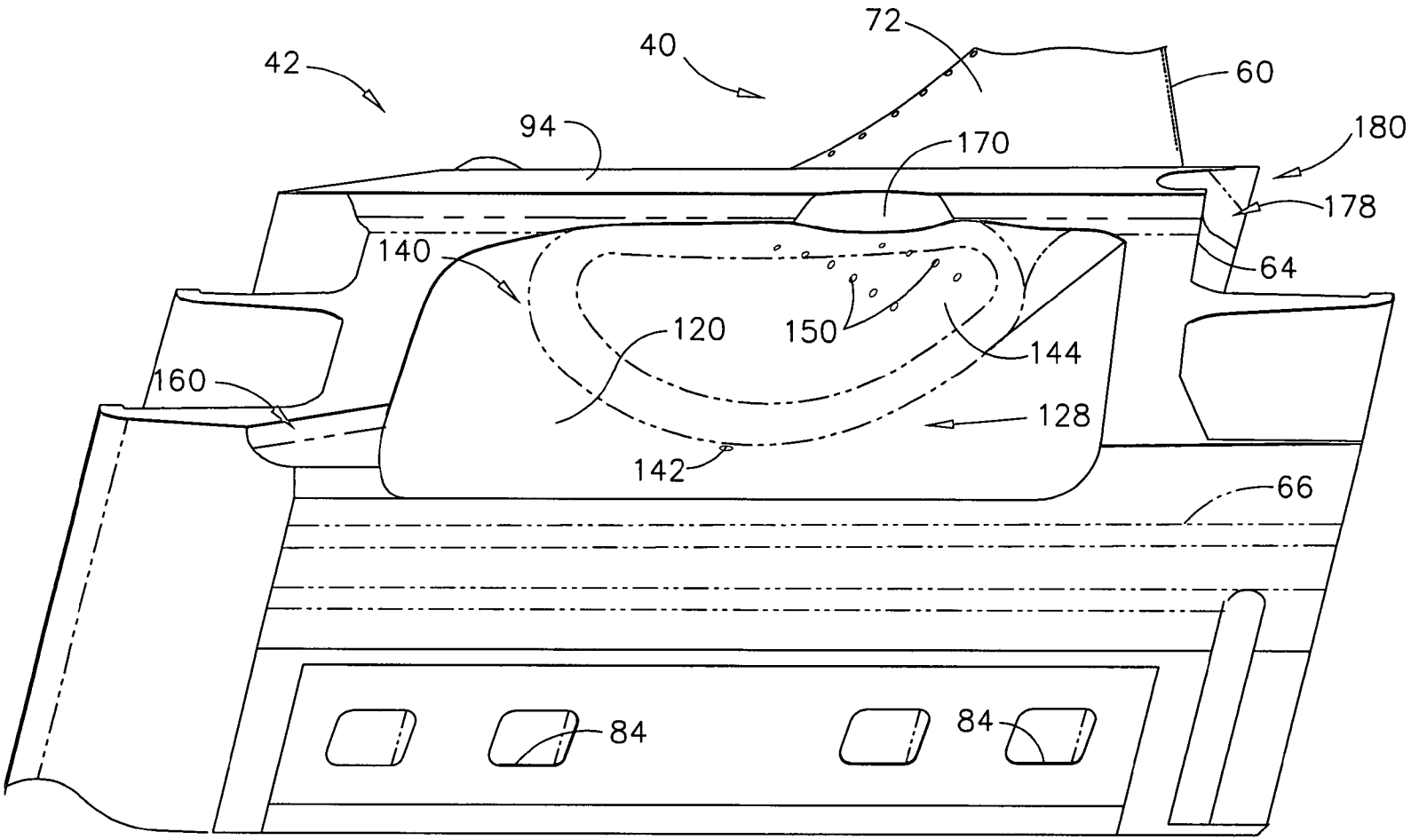
FIG. 3 is an enlarged perspective view of the rotor blade shown in FIG. 2 and viewed from the underside of the rotor blade.
Figure 4:
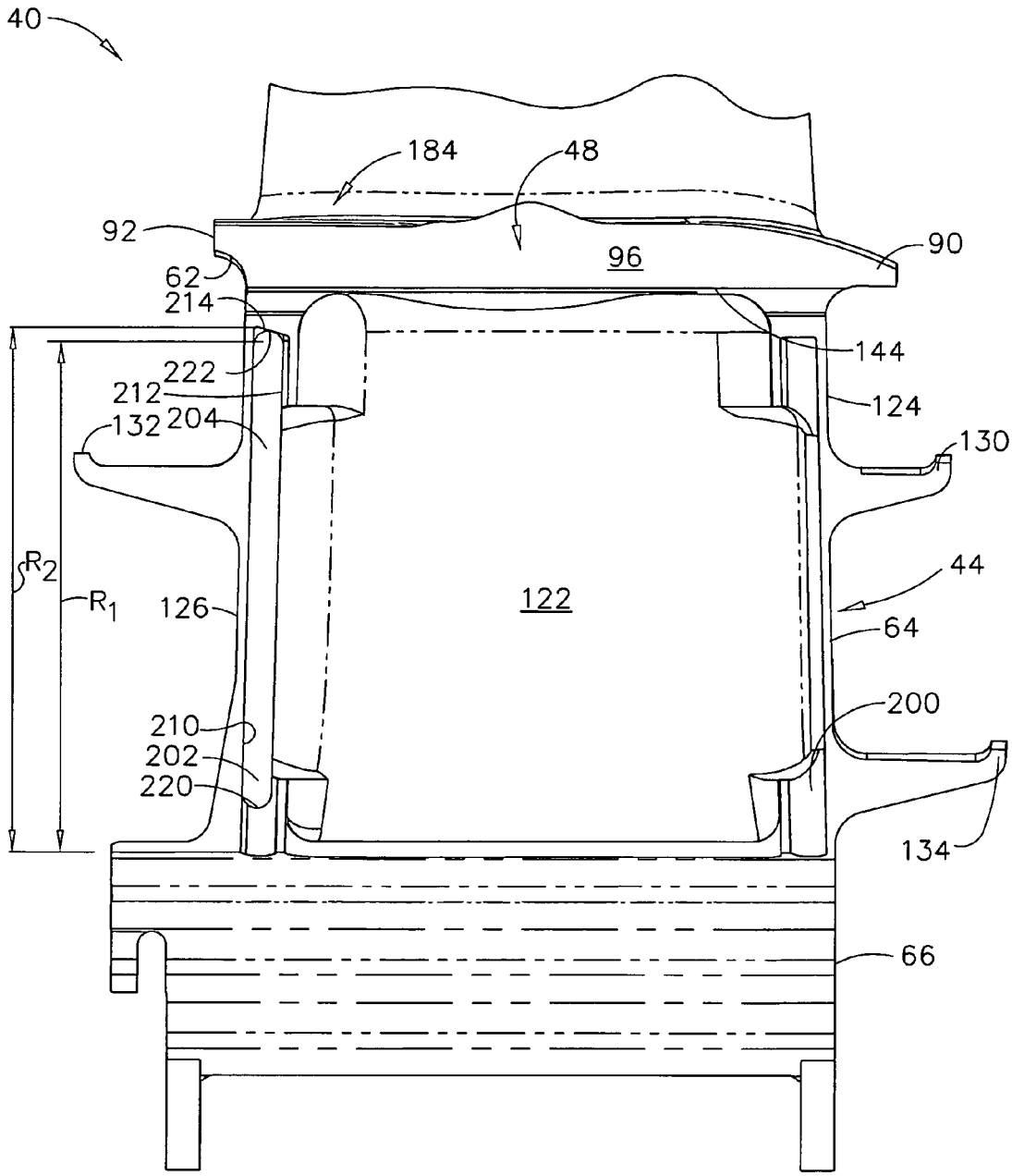
FIG. 4 is a side view of the rotor blade shown in FIG. 2 and viewed from the opposite side shown in FIG. 2.
Figure 5:
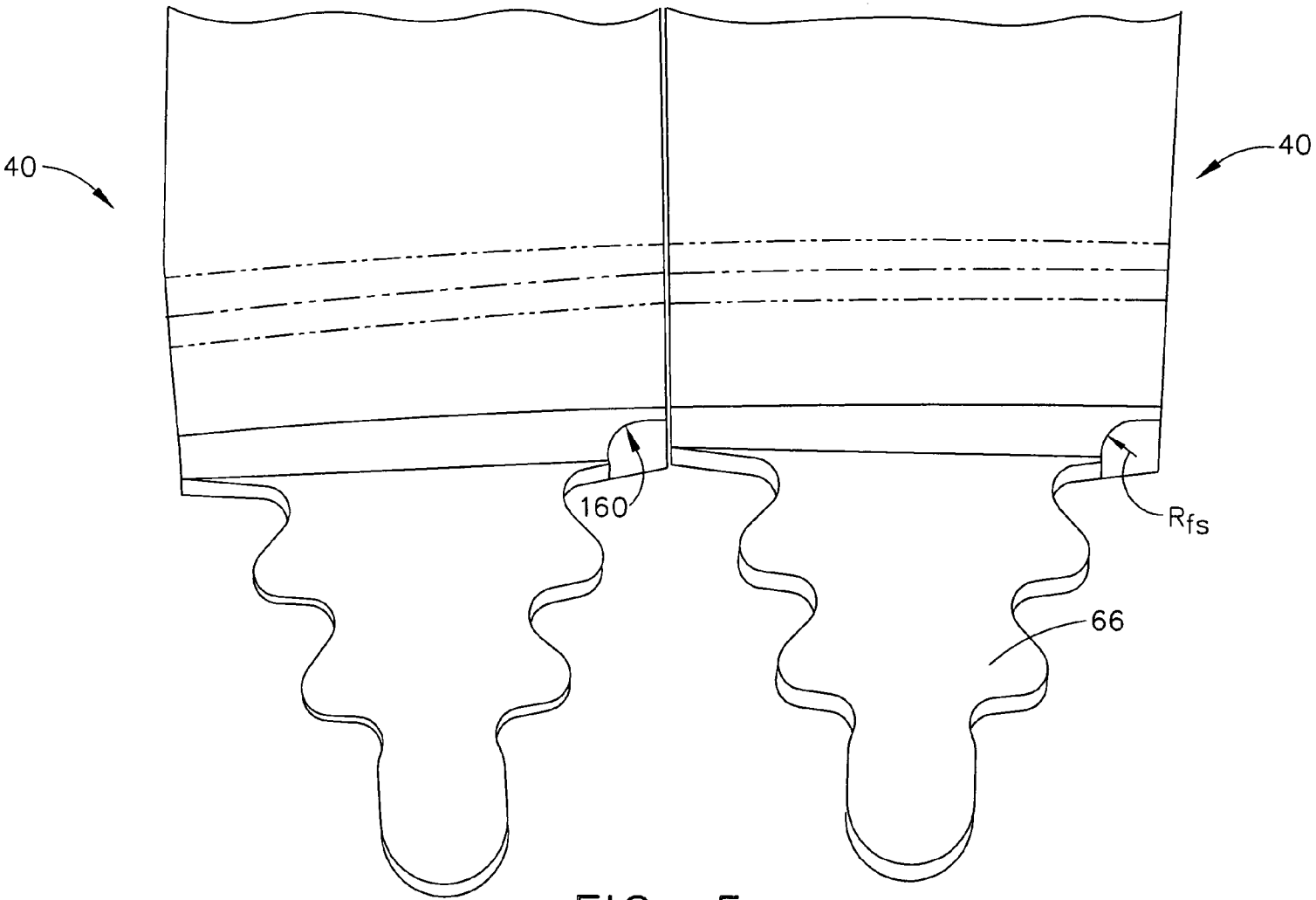
FIG. 5 illustrates a relative orientation of the circumferential spacing between the rotor blade shown in FIG. 2 and other rotor blades when coupled within the gas turbine engine shown in FIG. 1.
Figure 6:
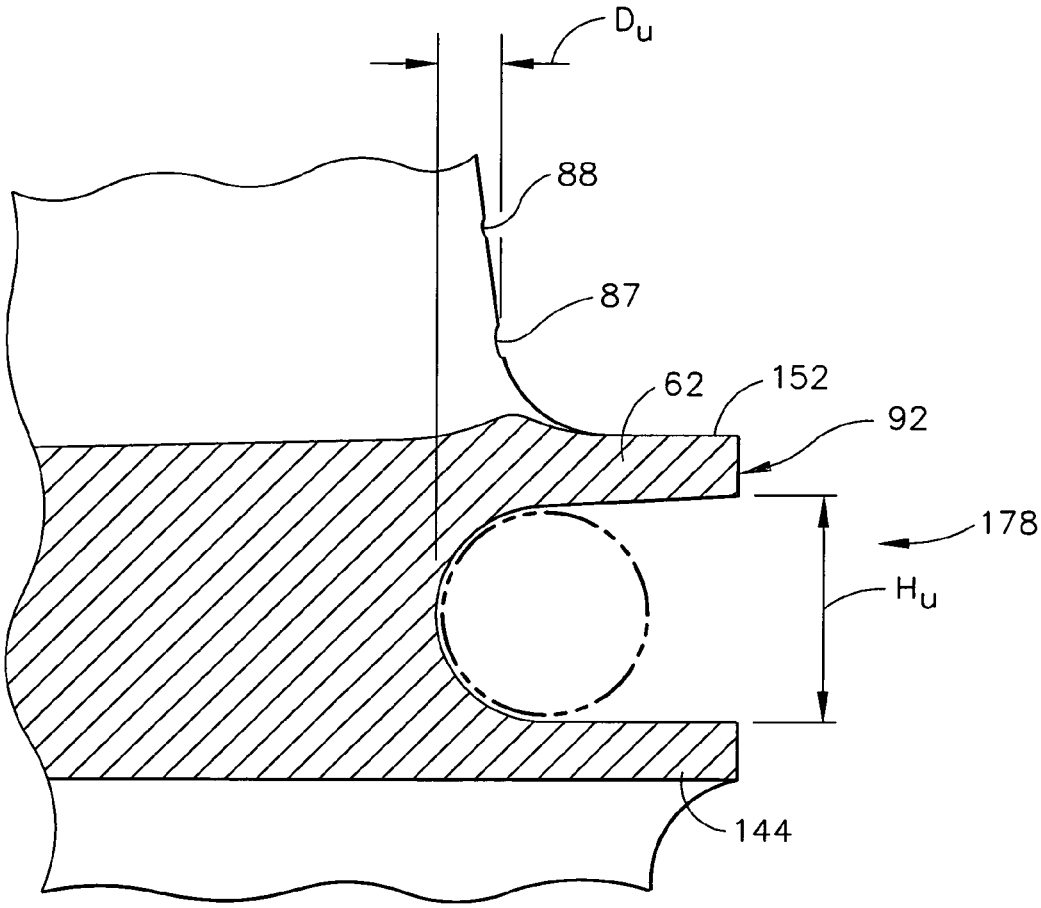
FIG. 6 is an enlarged side view of a portion of the rotor blade shown in FIG. 2 and taken along area 6.

FIG. 2 is an enlarged perspective view of a rotor blade 40 that may be used with gas turbine engine 10 (shown in FIG. 1) viewed from a first side 42 of rotor blade 40. FIG. 3 is an enlarged perspective view of rotor blade 40 and viewed from the underside of the rotor blade 40, and FIG. 4 is a side view of rotor blade shown in FIG. 2 and viewed from an opposite second side 44 of rotor blade 40. FIG. 5 illustrates a relative orientation of the circumferential spacing between circumferentially-spaced rotor blades 40 when blades 40 are coupled within a rotor assembly, such as turbine 14 (shown in FIG. 1). FIG. 6 is an enlarged side view of rotor blade 40 taken along area 6 shown in FIG. 2. In one embodiment, blade 40 is a newly cast blade 40. In an alternative embodiment, blade 40 is a blade 40 that is retrofitted to include the features described herein. More specifically, when rotor blades 40 are coupled within the rotor assembly, a gap 48 is defined between the circumferentially-spaced rotor blades 40.

When coupled within the rotor assembly, each rotor blade 40 is coupled to a rotor disk (not shown) that is rotatably coupled to a rotor shaft, such as shaft 18 (shown in FIG. 1). In an alternative embodiment, blades 40 are mounted within a rotor spool (not shown). In the exemplary embodiment, blades 40 are identical and each extends radially outward from the rotor disk and includes an airfoil 60, a platform 62, a shank 64, and a dovetail 66. In an alternative embodiment, the rotor assembly includes a plurality of different rotor blades, such that, for example, rotor blade 40 is positioned adjacent a non-identical rotor blade. In the exemplary embodiment, airfoil 60, platform 62, shank 64, and dovetail 66 are collectively known as a bucket.

Each airfoil 60 includes first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 62, to an airfoil tip 80. Airfoil tip 80 defines a radially outer boundary of an internal cooling chamber 84 within blades 40. More specifically, internal cooling chamber 84 is bounded within airfoil 60 between sidewalls 70 and 72, and extends through platform 62 and through shank 64 and into dovetail 66.

Each airfoil 60 also includes a plurality of trailing edge openings 86. In the exemplary embodiment, openings 86 extend radially between airfoil tip 80 and blade root 78 for discharging cooling fluid from cooling chamber 84 to facilitate cooling airfoil trailing edge 76. More specifically, openings 86 include a root opening 87, a second opening 88, and a plurality of remaining openings 89. Root opening 87 is between blade root 78 and second opening 88, and second opening 88 is between root opening 87 and remaining openings 89. Openings 89 extend between second opening 88 and airfoil tip 80. In the exemplary embodiment, openings 89 are substantially equi-spaced between opening 88 and airfoil tip 80.

Platform 62 extends between airfoil 60 and shank 64 such that each airfoil 60 extends radially outward from each respective platform 62. Shank 64 extends radially inwardly from platform 62 to dovetail 66, and dovetail 66 extends radially inwardly from shank 64 to facilitate securing rotor blades 40 to the rotor disk. Platform 62 also includes an upstream side or skirt 90 and a downstream side or skirt 92 which are connected together with a pressure-side edge 94 and an opposite suction-side edge 96. When rotor blades 40 are coupled within the rotor assembly, gap 48 is defined between adjacent rotor blade platforms 62, and accordingly is known as a platform gap.

Shank 64 includes a substantially concave sidewall 120 and a substantially convex sidewall 122 connected together at an upstream sidewall 124 and a downstream sidewall 126 of shank 64. Accordingly, shank sidewall 120 is recessed with respect to upstream and downstream sidewalls 124 and 126, respectively, such that when buckets 40 are coupled within the rotor assembly, a shank cavity 128 is defined between adjacent rotor blade shanks 64.

In the exemplary embodiment, a forward angel wing 130 and an aft angel wing 132 each extend outwardly from respective shank sides 124 and 126 to facilitate sealing forward and aft angel wing buffer cavities (not shown) defined within the rotor assembly. In addition, a forward lower angel wing 134 also extends outwardly from shank side 124 to facilitate sealing between buckets 40 and the rotor disk. More specifically, forward lower angel wing 134 extends outwardly from shank 64 between dovetail 66 and forward angel wing 130.

A cooling circuit 140 is defined through a portion of shank 64 to provide impingement cooling air for cooling platform 62, as described in more detail below. Specifically, cooling circuit 140 includes an impingement cooling opening 142 formed within shank concave sidewall 120 such that bucket internal cooling cavity 84 and shank cavity 128 are coupled together in flow communication. More specifically, opening 142 functions generally as a cooling air jet nozzle and is obliquely oriented with respect to platform 62 such that cooling air channeled through opening 142 is discharged towards a radially inner surface 144 of platform 62 to facilitate impingement cooling of platform 62.

In the exemplary embodiment, platform 62 also includes a plurality of film cooling openings 150 extending through platform 62. In an alternative embodiment, platform 62 does not include openings 150. More specifically, film cooling openings 150 extend between a radially outer surface 152 of platform 62 and platform radially inner surface 144. Openings 150 are obliquely oriented with respect to platform outer surface 152 such that cooling air channeled from shank cavity 128 through openings 150 facilitates film cooling of platform radially outer surface 152. Moreover, as cooling air is channeled through openings 150, platform 62 is convectively cooled along the length of each opening 150.

To facilitate increasing a pressure within shank cavity 128, in the exemplary embodiment, shank sidewall 124 includes a recessed or scalloped portion 160 formed radially inward from forward lower angel wing 134. In the exemplary embodiment, recessed portion 160 is also known as a forward shank slot. In an alternative embodiment, forward lower angel wing 134 does not include scalloped portion 160. In another alternative embodiment, scalloped portion 160 is formed below angel wing 130. Accordingly, when adjacent rotor blades 40 are coupled within the rotor assembly, recessed portion 160 enables additional cooling air to flow into shank cavity 128 to facilitate increasing an operating pressure within shank cavity 128. As such, recessed portion 160 facilitates maintaining a sufficient back flow margin for platform film cooling openings 150.

In the exemplary embodiment, recessed portion 160 is formed with a predefined radius $R_{fs}$. In one embodiment, recessed portion radius $R_{fs}$ is approximately equal to 0.187 inches. In alternative embodiments, recessed portion 160 has other cross-sectional shapes.

In the exemplary embodiment, platform 62 also includes a recessed portion or undercut purge slot 170. In an alternative embodiment, platform 62 does not include slot 170. More specifically, slot 170 is only defined within platform radially inner surface 144 along platform pressure-side edge 94 and extends towards platform radially outer surface 152 between shank upstream and downstream sidewalls 124 and 126. In an alternative embodiment, platform slot 170 is formed along platform suction-side 96. Slot 170 facilitates channeling cooling air from shank cavity 128 through platform gap 48 such that gap 48 is substantially continuously purged with cooling air.

In addition, in the exemplary embodiment, a platform undercut or trailing edge recessed portion 178 is defined within platform 62. In an alternative embodiment, platform 62 does not include trailing edge recessed portion 178. Platform undercut 178 is defined within platform 62 between platform radially inner and outer surfaces 144 and 152, respectively, and has a height $H_u$. More specifically, platform undercut 178 is defined within platform downstream skirt 92 at an interface 180 defined between platform pressure-side edge 94 and platform downstream skirt 92. Accordingly, when adjacent rotor blades 40 are coupled within the rotor assembly, undercut 178 facilitates improving trailing edge cooling of platform 62. Moreover, undercut 178 also facilitates reducing stresses induced to trailing edge openings 87 and 88, as described in more detail below.

In the exemplary embodiment, undercut 178 has an elliptical cross-section and is oriented substantially perpendicularly with respect to a mean camber line (not shown) extended through airfoil trailing edge 76. Alternatively, undercut 178 is oriented non-perpendicularly to the mean camber line extending through airfoil trailing edge 76. In other alternative embodiments, undercut 178 has a non-elliptical cross-section. Specifically, undercut 178 extends for an undercut depth $D_u$ that is a predetermined distance inward from trailing edge 76 adjacent root opening 87. In one embodiment, distance $D_u$ is approximately equal to 0.010 inches, and undercut height $H_u$ is approximately equal to 0.394 inches. The cross-sectional shape, depth $D_u$, and height $H_u$ of undercut 178 may vary depending on the application and the desired load distribution between airfoil trailing edge 76 and undercut 178. Generally, as described in more detail below, increasing undercut depth $D_u$ decreases trailing edge stress and increases undercut stress, and vice versa.

In the exemplary embodiment, a portion 184 of platform 62 is also chamfered along platform suction-side edge 96. In an alternative embodiment, platform 62 does not include chamfered portion 184. More specifically, chamfered portion 184 extends across platform radially outer surface 152 adjacent to platform downstream skirt 92. Accordingly, because chamfered portion 184 is recessed in comparison to platform radially outer surface 152, portion 184 defines an aft-facing step for flow across platform gap 48 such that a heat transfer coefficient across a suction side of platform 62 is facilitated to be reduced. Accordingly, because the heat transfer coefficient is reduced, the operating temperature of platform 62 is also facilitated to be reduced, thus increasing the useful life of platform 62.

Shank 64 also includes a leading edge radial seal pin slot 200 and a trailing edge radial seal pin slot 202. Specifically, each seal pin slot 200 and 202 extends generally radially through shank 64 between platform 62 and dovetail 66. More specifically, leading edge radial seal pin slot 200 is defined within shank upstream sidewall 124 adjacent to shank convex sidewall 122, and trailing edge radial seal pin slot 202 is defined within shank downstream sidewall 126 adjacent to shank convex sidewall 122.

Each shank seal pin slot 200 and 202 is sized to receive a radial seal pin 204 to facilitate sealing between adjacent rotor blade shanks 64 when rotor blades 40 are coupled within the rotor assembly. Although leading edge radial seal pin slot 200 is sized to receive a radial seal pin 204 therein, in the exemplary embodiment, when rotor blades 40 are coupled within the rotor assembly, a seal pin 204 is only positioned within trailing edge seal pin slot 202 and slot 200 remains empty. More specifically, because slot 200 does not include a seal pin 204, a gap remains and during operation, slot 200 cooperates with shank scalloped portion 160 to facilitate pressurizing cavity 128 such that a sufficient back flow margin is maintained within shank cavity 128.

Trailing edge radial seal pin slot 202 is defined by a pair of opposed axially-spaced sidewalls 210 and 212, and extends radially between dovetail 66 and a radially upper wall 214. In the exemplary embodiment, sidewalls 210 and 212 are substantially parallel within shank downstream sidewall 126, and radially upper wall 214 extends obliquely therebetween. Accordingly, a radial height $R_1$ of inner sidewall 212 is shorter than a radial height $R_2$ of outer sidewall 210. As explained in more detail below, oblique upper wall 214 facilitates enhancing the sealing effectiveness of trailing edge seal pin 204. More specifically, during engine operation, sidewall 214 enables pin 204 to slide radially within slot 202 until pin 204 is firmly positioned against sidewall 210. The radial and axial movement of pin 204 within slot 202 facilitates enhancing sealing between adjacent rotor blades 40. Moreover, in the exemplary embodiment, each end 220 and 222 of trailing edge seal pin 204 is rounded to facilitate radial movement of pin 204, and thus also facilitate enhancing sealing between adjacent rotor blade shanks 64.

During engine operation, at least some cooling air supplied to blade internal cooling chamber 84 is discharged outwardly through shank opening 142. More specifically, opening 142 is oriented such that air discharged therethrough is directed towards platform 62 for impingement cooling of platform radially inner surface 144. Generally, during engine operation, bucket pressure side 42 generally operates at higher temperatures than rotor blade suction side 44, and as such, during operation, cooling opening 142 facilitates reducing an operating temperature of platform 62.

Moreover, airflow discharged from opening 142 is also mixed with cooling air entering shank cavity 128 through shank sidewall recessed portion 160. More specifically, the combination of shank sidewall recessed portion 160 and the empty leading edge radial seal pin slot 200 facilitates maintaining a sufficient back flow margin within shank cavity 128 such that at least a portion of the cooling air within shank 128 may be channeled through platform undercut purge slot 170 and through platform gap 48, and such that a portion of the cooling air may be channeled through film cooling openings 150. As the cooling air is forced outward through purge slot 170 and gap 48, platform 62 is convectively cooled. Moreover, during operation, undercut 178 is cooled by air forced outward through purge slot 170 and is channeled along gap 48, such that undercut 178 facilitates reducing an operating temperature of platform 62 within platform downstream skirt 92. In addition, platform 62 is both convectively cooled and film cooled by the cooling air channeled through openings 150.

During operation, undercut depth $D_u$ causes a change to the load path direction away from airfoil trailing edge 76. The change in load path direction away from edge 76 facilitates reducing stresses induced to airfoil trailing edge 76 adjacent root 78 and trailing edge openings 87 and 88. Accordingly, and more specifically, during operation, undercut 178 facilitates reducing mechanical and thermal stresses induced to openings 87 and 88, thus increasing the fatigue life of the airfoil region. More specifically, because undercut 178 is actively cooled by cooling air channeled through platform undercut purge slot 170 from shank cavity 128, undercut 178 is defined in region of cooler metal temperatures, the fatigue capability is facilitated to be increased within this same airfoil region.

In addition, because platform chamfered portion 184 defines an aft-facing step for flow across platform 62, the heat transfer coefficient across a suction side of platform 62 is also facilitated to be reduced. The combination of opening 142, openings 150, recessed portion 160, undercut purge slot 170, and slot 200 facilitate reducing the operating temperature of platform 62 such that thermal strains induced to platform 62 are also reduced.

The above-described rotor blades provide a cost-effective and highly reliable method for supplying cooling air to facilitate reducing an operating temperature of the rotor blade platform. More specifically, through convective cooling flow, film cooling, and impingement cooling, thermal stresses induced within the platform, and the operating temperature of the platform is facilitated to be reduced. Accordingly, platform oxidation, platform cracking, and platform creep deflection is also facilitated to be reduced. Moreover, fatigue cracking of the trailing edge openings is facilitated to be reduced by the cooling circuit described above. As a result, the rotor blade cooling circuit facilitates extending a useful life of the rotor assembly and improving the operating efficiency of the gas turbine engine in a cost-effective and reliable manner.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade cooling circuit component can also be used in combination with other rotor blades, and is not limited to practice with only rotor blade 40 as described herein. Rather, the present invention can be implemented and utilized in connection with many other blade and cooling circuit configurations. For example, it should be recognized by one skilled in the art, that the platform impingement opening can be utilized with various combinations of platform cooling features including film cooling openings, platform scalloped portions, platform recessed trailing edge slots, shank recessed portions, and/or platform chamfered portions.

While the invention has been described in terms of various specific embodiments, those skilled in the art will recognize that the invention can be practiced with modification within the spirit and scope of the claims.

What is claimed is:

1. A method for assembling a rotor assembly for gas turbine engine, said method comprising:

providing a first rotor blade that includes an airfoil having a leading edge and a trailing edge including a plurality of trailing edge openings, a platform, a shank, an internal cavity, and a dovetail, wherein the platform extends between the airfoil and the dovetail and includes a radially outer surface, a radially inner surface, and a recessed area extending at least partially between the radially outer and inner surfaces, wherein the internal cavity is defined at least partially by the shank and wherein each shank includes a pair of opposing sidewalls that extend between an upstream sidewall and a downstream sidewall;

coupling the first rotor blade to a rotor shaft using the dovetail such that at least a portion of the first rotor blade platform radially inner surface can be impingement cooled by cooling air channeled from the blade cavity; and coupling a second rotor blade to the rotor shaft to facilitate increasing fatigue life of the airfoil trailing edge and such that cooling air can be substantially continuously channeled through the platform recessed area during engine operation to facilitate reducing stresses induced to at least a portion of the airfoil trailing edge, and such that a shank cavity is defined between the first and second rotor blade shanks, and such that a platform gap is defined between the first and second rotor blade platforms.

2. A method in accordance with claim 1 wherein coupling the second rotor blade to a rotor shaft further comprises coupling the second rotor blade to the shaft such that during engine operation cooling air is channeled from the shank cavity to facilitate reducing stresses induced to at least a portion of the airfoil trailing edge.

3. A method in accordance with claim 1 wherein providing a first rotor blade further comprises providing a first rotor blade wherein the recessed area extends into a load path of the airfoil.

4. A method in accordance with claim 1 wherein coupling the second rotor blade to a rotor shaft further comprises coupling the second rotor blade to the shaft such that during operation each rotor blade platform radially outer surface is film cooled by cooling air channeled through a plurality of film cooling openings that extend between the platform radially inner and outer surfaces.

5. A method in accordance with claim 1 wherein providing a first rotor blade further comprises providing a first rotor blade wherein the recessed area extends into a load path of the airfoil created by the rotor blade during engine operation.

6. A method in accordance with claim 1 wherein providing a first rotor blade further comprises providing a first rotor blade wherein the recessed area is oriented substantially perpendicularly to a mean camber line extending through the airfoil trailing edge.

7. A method in accordance with claim 1 wherein providing a first rotor blade further comprises providing a first rotor blade wherein the recessed area has a substantially elliptical cross-sectional area.

8. A method in accordance with claim 1 wherein each rotor blade shank also includes a leading edge seal pin cavity and a trailing edge seal pin cavity, said coupling a second rotor blade to the rotor shaft further comprises positioning a seal pin in only the trailing edge seal pin cavity prior to coupling the second rotor blade to the rotor shaft.

9. A rotor blade for a gas turbine engine, said rotor blade comprising:

a platform comprising a radially outer surface, a radially inner surface, a purge slot, and a recessed area extending at least partially therebetween, said purge slot formed within at least a portion of said platform radially inner surface for channeling cooling air through said platform recessed area, wherein said platform recessed area is oriented substantially perpendicularly to a mean camber line extending through said airfoil trailing edge;

an airfoil extending radially outward from said platform, said airfoil comprising a first sidewall and a second sidewall connected together along a leading edge and a trailing edge;

a shank extending radially inward from said platform;

a dovetail extending from said shank;

an internal cavity defined at least partially by said shank, said cavity for providing cooling air for impingement cooling at least a portion of said platform radially inner surface; and a cooling circuit extending through a portion of said shank for channeling cooling air through said platform recessed area during engine operation to facilitate reducing stresses induced to at least a portion of said airfoil trailing edge.

10. A rotor blade in accordance with claim 9 wherein said platform further comprises a plurality of film cooling openings extending between said platform radially outer and radially inner surfaces, said plurality of film cooling openings for channeling cooling air for film cooling said platform radially outer surface.

11. A rotor blade in accordance with claim 9 wherein said shank extends axially between a forward sidewall and an aft sidewall, at least a portion of said forward sidewall is recessed to facilitate increasing an operating pressure of cooling air supplied through said platform recessed area.

12. A rotor blade in accordance with claim 9 wherein said platform recessed area extends into a load path of said airfoil created by said rotor blade during engine operation.

13. A rotor blade in accordance with claim 9 wherein said platform recessed area facilitates increasing fatigue life of said airfoil trailing edge.

14. A rotor blade in accordance with claim 9 wherein said shank further comprises a leading edge seal pin cavity and a trailing edge seal pin cavity, each said pin cavity configured to facilitate sealing between adjacent said rotor blades.

15. A rotor blade in accordance with claim 9 wherein said platform recessed area has a substantially elliptical cross-sectional area.

16. A gas turbine engine rotor assembly comprising:

a rotor shaft; and a plurality of circumferentially-spaced rotor blades coupled to said rotor shaft, each said rotor blade comprising an airfoil, a platform, a shank, a cooling circuit, and a dovetail, said airfoil extending radially outward from said platform, each said platform comprising a radially outer surface, a radially inner surface, and a recessed area extending at least partially therebetween, said platform recessed area extends into a load path of said airfoil created by each said rotor blade during engine operation, each said shank extending radially inward from said platform, each said dovetail extending from said shank for coupling said rotor blade to said rotor shaft, each said cooling circuit extending through a portion of said shank for channeling cooling air through said platform recessed area during engine operation to facilitate reducing stresses induced to at least a portion of said airfoil trailing edge, said platform further comprising a plurality of film cooling openings extending between said platform radially outer and inner surfaces, each said shank comprises a pair of opposing sidewalls extending between an upstream sidewall and a downstream sidewall, said plurality of rotor blades are circumferentially-spaced such that a shank cavity is defined between each pair of adjacent said rotor blades.

17. A gas turbine engine in accordance with claim 16 wherein at least said first rotor blade further comprises a purge slot defined within at least a portion of said platform radially inner surface, said purge slot for channeling cooling air from said shank cavity through said platform recessed area.

18. A gas turbine engine in accordance with claim 16 wherein said plurality of film cooling openings for channeling cooling air from said shank cavity for film cooling said platform radially outer surface.

19. A gas turbine engine in accordance with claim 16 wherein at least a portion of first rotor blade shank upstream sidewall is recessed to facilitate pressurizing said shank cavity during engine operation.

20. A gas turbine engine in accordance with claim 16 wherein each rotor blade shank further comprises a leading edge seal pin cavity and a trailing edge seal pin cavity, each said seal pin cavity sized to receive a seal pin therein to facilitate sealing between circumferentially adjacent said rotor blades.

21. A gas turbine engine in accordance with claim 20 wherein said first rotor blade further comprises only one radial seal pin, said radial seal pin is positioned within said trailing edge seal pin cavity when said first rotor blade is coupled within said gas turbine engine to facilitate increasing platform film cooling through said empty remaining seal pin cavity.

22. A gas turbine engine in accordance with claim 16 wherein each said platform recessed area facilitates increasing fatigue life of each said airfoil trailing edge.

23. A gas turbine engine in accordance with claim 16 wherein each said platform recessed area is oriented substantially perpendicularly to a mean camber line extending through each said airfoil trailing edge.

24. A gas turbine engine in accordance with claim 16 wherein each said platform recessed area is defined by a substantially elliptical cross-sectional area.

* * * * *